US008913943B2

(12) United States Patent
Nakane et al.

(10) Patent No.: US 8,913,943 B2
(45) Date of Patent: Dec. 16, 2014

(54) IMAGE FORMING APPARATUS

(71) Applicants: Yoshiki Nakane, Toyokawa (JP); Yohei Ito, Toyokawa (JP)

(72) Inventors: Yoshiki Nakane, Toyokawa (JP); Yohei Ito, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 59 days.

(21) Appl. No.: 13/779,192

(22) Filed: Feb. 27, 2013

(65) Prior Publication Data

US 2013/0243505 A1 Sep. 19, 2013

(30) Foreign Application Priority Data

Mar. 15, 2012 (JP) ..... 2012-058686

(51) Int. Cl.
*G03G 21/00* (2006.01)

(52) U.S. Cl.
CPC ..... *G03G 21/0035* (2013.01); *G03G 21/0011* (2013.01); *G03G 21/0094* (2013.01)
USPC ..... 399/346; 399/350; 399/353

(58) Field of Classification Search
USPC ..... 399/123, 343, 346, 350, 353, 354
See application file for complete search history.

(56) References Cited

U.S. PATENT DOCUMENTS

| | | | | |
|---|---|---|---|---|
| 7,076,199 | B2 * | 7/2006 | Nishida | 399/346 |
| 7,693,475 | B2 * | 4/2010 | Shakuto et al. | 399/346 |
| 7,826,786 | B2 * | 11/2010 | Suda et al. | 399/346 |
| 8,135,326 | B2 | 3/2012 | Ohno et al. | |
| 8,364,069 | B2 * | 1/2013 | Arai et al. | 399/346 |
| 8,577,274 | B2 * | 11/2013 | Tawada et al. | 399/346 |

FOREIGN PATENT DOCUMENTS

| | | | |
|---|---|---|---|
| JP | 2001-265185 | A | 9/2001 |
| JP | 2005-189594 | A | 7/2005 |
| JP | 2007-310336 | A | 11/2007 |
| JP | 2008-275724 | A | 11/2008 |
| JP | 2009-162790 | A | 7/2009 |
| JP | 2010-097164 | A | 4/2010 |
| JP | 2010-113122 | A | 5/2010 |
| JP | 2010-156778 | A | 7/2010 |
| JP | 2010-160445 | A | 7/2010 |
| JP | 2011-070041 | A | 4/2011 |

OTHER PUBLICATIONS

Office Action (Notification of Reason for Refusal) issued on Jan. 21, 2014, by the Japan Patent Office in corresponding Japanese Patent Application No. 2012-058686, and an English Translation of the Office Action (7 pages).

(Continued)

*Primary Examiner* — Hoan Tran
(74) *Attorney, Agent, or Firm* — Buchanan Ingersoll & Rooney PC

(57) ABSTRACT

In an image forming apparatus, a cleaning unit includes: a cleaning blade that scrapes off untransferred toner remaining on an image support; an application brush that contacts the image support on the downstream side in the rotational direction of the image support relative to the cleaning blade, the application brush rotating in a counter direction at a contact position with the image support, thereby scratching off lubricant particles from a solid lubricant provided at its periphery, and supporting and feeding the lubricant particles toward the contact position with the image support; and a moving force providing unit that provides the lubricant being fed by the application brush with an electrical moving force toward the image support, on the upstream side in the rotational direction of the application brush relative to the contact position of the image support and the application brush.

10 Claims, 6 Drawing Sheets

(56) References Cited

OTHER PUBLICATIONS

Office Action (Notification of Reason for Refusal) issued on Jul. 8, 2014, by the Japan Patent Office in corresponding Japanese Patent Application No. 2012-058686, and an English Translation of the Office Action (6 pages).

* cited by examiner

IMAGE FORMING APPARATUS

This application is based on Japanese Patent Application No. 2012-58686 filed on Mar. 15, 2012, the content of which is incorporated herein by reference.

BACKGROUND OF THE INVENTION

1. Field of the Invention

The present invention relates to an image forming apparatus with an application unit for applying a lubricant to an image support.

2. Description of Related Art

In an electrographic image forming apparatus, as shown in FIG. 7, the circumferential surface of an image support 102 is uniformly charged by a charging unit 101, and then irradiated with an optical beam so that an electrostatic latent image is formed thereon. Thereafter, in the image forming apparatus, a developing unit 103 develops the electrostatic latent image on the image support 102, thereby forming a toner image. Moreover, in the image forming apparatus, the toner image formed on the image support 102 is transferred onto a sheet material such as paper, and then the transferred toner image is fused and fixed on the sheet material. The image forming apparatus also includes a cleaning unit 104 provided so as to contact the image support 102 for the purpose of removing toner remaining on the image support 102 without being transferred onto the sheet material (hereinafter, such toner will be referred to below as untransferred toner). The cleaning unit 104 includes a cleaning blade 105 made of strips of polyurethane. The cleaning blade 105 is pressed against the image support 102, thereby scraping off untransferred toner.

In recent years, to reduce downtime of the image forming apparatus, there is demand for extended service lives of the image support 102 and the cleaning blade 105. A factor that limits the service lives is an amount of abrasion. In an abrasion reduction technique in practical use, an application brush 107 is used to apply a solid lubricant 106 onto the circumferential surface of the image support 102, thereby forming a film of solid lubricant (referred to below as a lubricant film) thereon.

However, reducing the amount of abrasion of the image support 102 means reducing the force of the application brush 107 scrubbing the circumferential surface of the image support 102, resulting in other issues. The most critical of all is an image defect. Specifically, charged products (such as $O_3$ and $NO_x$) generated by the charging unit 101 adhere to the image support 102. The adhering charged products might be left unscrubbed when the lubricant film weakens the scrubbing force of the image support 102. The remaining charged products might lower the surface resistance of the image support 102, making the electrostatic latent image on the image support 102 defective. Accordingly, for example, a resultant print includes an image with blurry edges or a half-tone image with white spots. Such image noise is included in the image defect. Note that in the case where the amount of abrasion of the image support 102 is high, charged products are scrubbed together with the film on the surface of the image support 102, so that no image defect is caused.

The mechanism of the image defect will now be described in more detail. In the following, the percentage of applied lubricant is a value obtained by dividing the amount of solid lubricant 106 applied to the image support 102 by the amount of lubricant scraped by the application brush 107. In the configuration of FIG. 7, both the image support 102 and the application brush 107 rotate counterclockwise, and the percentage of applied lubricant is less than 50%, so that there are numerous lubricant particles 108 (represented by small circles) where the image support 102 and the application brush 107 contact each other, as shown in FIG. 8. The lubricant particles 108 have a low friction coefficient, and therefore reduce a frictional force generated between the image support 102 and the application brush 107. As a result, the application brush 107 cannot achieve the effect of scrubbing the circumferential surface of the image support 102, so that charged products are not removed from the circumferential surface of the image support 102, causing an image defect.

An image forming apparatus capable of reducing the image defect is described in, for example, Japanese Patent Laid-Open Publication No. 2001-265185. This image forming apparatus includes a lubricity providing member, an application roller, and a friction coefficient adjusting member. The lubricity providing member and the friction coefficient adjusting member are arranged in this order along the rotational direction of the application roller. The lubricity providing member supplies a lubricant to the application roller. The application roller with the lubricant contacts the friction coefficient adjusting member, thereby removing excess lubricant from the application roller. Thereafter, the application roller applies the lubricant to the image support.

Incidentally, the lubricant film on the image support adsorbs charged products, and therefore, to prevent image defects, it is important to scrub the lubricant film with charged product adsorbed thereon, and form a new lubricant film without any charged product being adsorbed thereon.

However, simply adjusting the amount of lubricant to be supplied as in the approach described in Japanese Patent Laid-Open Publication No. 2001-265185 might not successfully remove the lubricant film with charged product adsorbed thereon, so that the lubricant film with charged product adsorbed thereon possibly remains on the image support, causing an image defect.

SUMMARY OF THE INVENTION

An image forming apparatus according to an embodiment of the present invention includes: a rotatable image support; a charging unit that charges the image support; an exposing unit that exposes the image support charged by the charging unit, thereby forming an electrostatic latent image; a developing unit that develops the electrostatic latent image formed by the exposing unit, thereby forming a toner image on the image support; a transfer unit that transfers the toner image formed on the image support to a transfer target in a transfer area; and a cleaning unit, in which the cleaning unit includes: a cleaning blade that is provided downstream from the transfer area in a rotational direction of the image support and scrapes off untransferred toner remaining on the image support; an application brush that contacts the image support on the downstream side in the rotational direction of the image support relative to the cleaning blade, the application brush rotating in a counter direction at a contact position with the image support, thereby scratching off lubricant particles from a solid lubricant provided at its periphery, and supporting and feeding the lubricant particles toward the contact position with the image support; and a moving force providing unit that provides the lubricant being fed by the application brush with an electrical moving force toward the image support, on the upstream side in the rotational direction of the application brush relative to the contact position of the image support and the application brush.

DETAILED DESCRIPTION OF THE PREFERRED EMBODIMENTS

Figure 1:
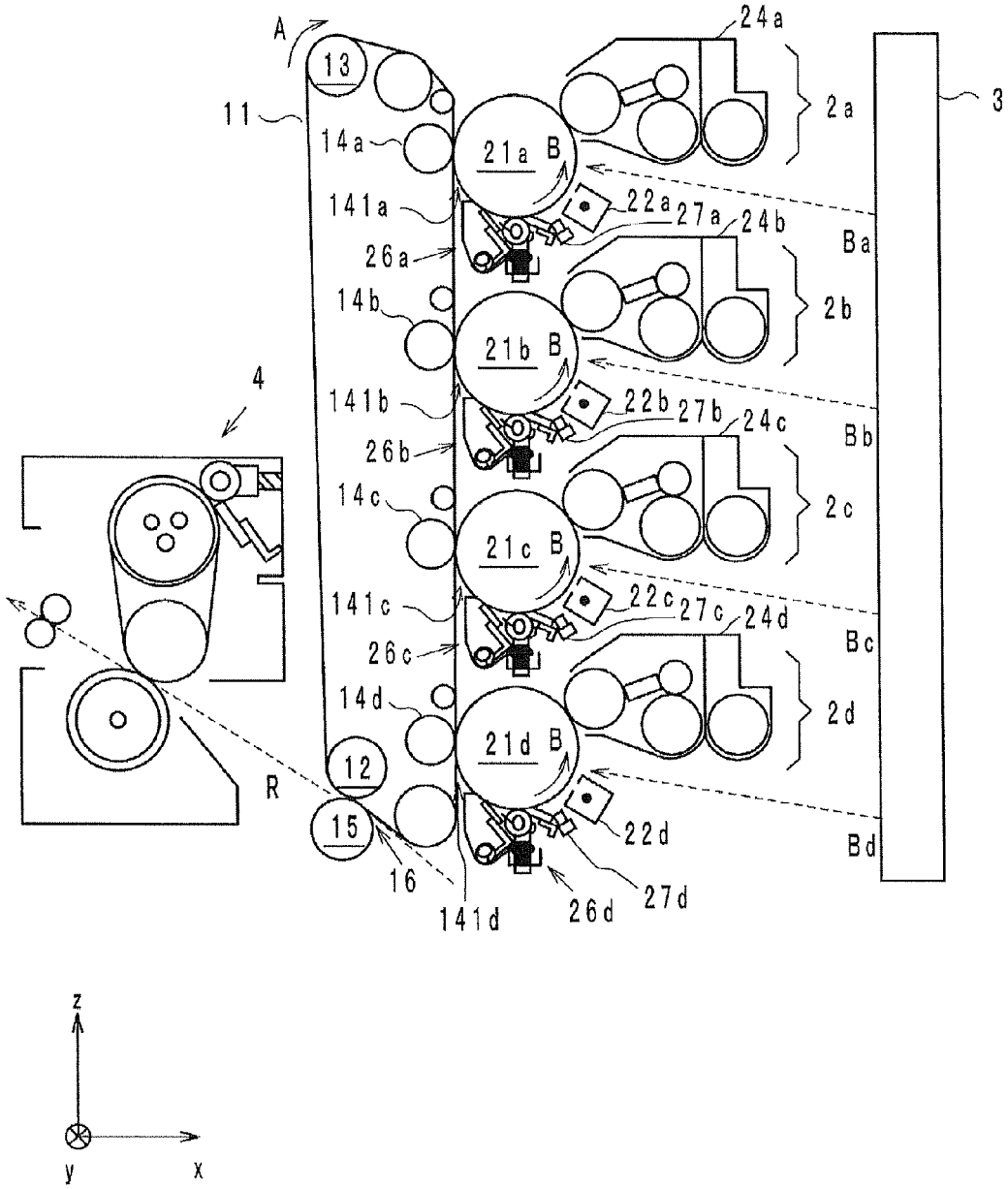
FIG. 1 is a schematic diagram illustrating essential parts of an image forming apparatus according to an embodiment of the present invention.

Hereinafter, an image forming apparatus according to an embodiment of the present invention will be described with reference to the drawings. In the drawings, the directions of X, Y, and Z-axes represent right-left (horizontal) direction, front-rear (depth) direction and top-bottom (height) direction, respectively, of the image forming apparatus. The lowercase alphabet letters a, b, c, and d suffixed to reference numerals are affixes that denote yellow (Y), magenta (M), cyan (C), and black (Bk). For example, a photoreceptor drum 21*a* is intended to mean a photoreceptor drum 21 for yellow.

Configurations of Essential Parts of Image Forming Apparatus

In FIG. 1, the image forming apparatus is, for example, an electrographic, tandem, full-color multifunction peripheral (MFP), color printer, copier, duplicator, or the like. The image forming apparatus includes an intermediate transfer belt 11. The intermediate transfer belt 11 is put on peripheries of a roller 12, a tension roller 13, etc., and is driven to rotate clockwise as indicated by arrow A.

In the main unit of the image forming apparatus, arranged to the right of the intermediate transfer belt 11 are imaging units, from top to bottom, 2*a*, 2*b*, 2*c*, and 2*d*. The imaging units 2*a* to 2*d* include photoreceptor drums 21*a* to 21*d*, which are typical examples of image supports. The photoreceptor drums 21*a* to 21*d* are in the form of cylinders extending in the depth direction of the image forming apparatus, and rotate about their central axes (counterclockwise as indicated by arrows B). Arranged around the photoreceptor drums 21*a* to 21*d* are, in order along their rotational directions B, charging units 22*a* to 22*d*, developing units 24*a* to 24*d*, cleaning units 26*a* to 26*d*, and diselectrifying units 27*a* to 27*d*.

Primary transfer rollers 14*a* to 14*d* are provided so as to be opposed to the photoreceptor drums 21*a* to 21*d* with respect to the intermediate transfer belt 11. Primary transfer areas 141*a* to 141*d* are created between the primary transfer rollers 14*a* to 14*d* and the intermediate transfer belt 11. In addition, a secondary transfer roller 15 is disposed so as to be opposed to the roller 12 with respect to the intermediate transfer belt 11 and tightly contact the intermediate transfer belt 11. A nip is created between the secondary transfer roller 15 and the intermediate transfer belt 11 as a secondary transfer area 16.

Furthermore, an exposing unit 3 is provided to the right of the imaging units 2*a* to 2*d*.

Furthermore, disposed below the main unit of the image forming apparatus is a sheet cassette in which sheet materials are placed, although the cassette is not shown in the figure. A feed roller provided in the sheet cassette forwards the sheet materials one by one to a feeding path R indicated by a dotted arrow. Provided in the feeding path R are a timing roller pair, a secondary transfer area 16, and a fusing unit 4, which are omitted in the figure.

General Operation of Image Forming Apparatus

Next, the general operation of the image forming apparatus thus configured will be described. In the image forming apparatus, the charging units 22*a* to 22*d* negatively charge the photoreceptor drums 21*a* to 21*d* uniformly across their circumferential surfaces. The exposing unit 3 irradiates the charged circumferential surfaces of the photoreceptor drums 21*a* to 21*d* with optical beams Ba to Bd modulated with image data (i.e., exposure). As a result, the photoreceptor drums 21*a* to 21*d* have electrostatic latent images of corresponding colors formed on their circumferential surfaces.

The developing units 24*a* to 24*d* supply toner, which is negatively charged by friction, to the photoreceptor drums 21*a* to 21*d* with the electrostatic latent images supported thereon (i.e., development). As a result, of the photoreceptor drums 21*a* to 21*d* has toner images of the corresponding colors formed on their circumferential surfaces. Here, a negative voltage (developing bias) is applied to the developing rollers included in the developing units 24*a* to 24*d*, for reversal development being selectively performed on the photoreceptor drums 21*a* to 21*d* when their potentials drop due to exposure.

Due to the voltage being applied to the primary transfer rollers 14*a* to 14*d*, the toner images on the photoreceptor drums 21*a* to 21*d* are electrostatically transferred to the intermediate transfer belt 11 (i.e., primary transfer), such that the transfer takes place at the same portion of the intermediate transfer belt 11, sequentially in the primary transfer areas 141*a* to 141*d*. In this manner, the toner images on the photoreceptor drums 21*a* to 21*d* are transferred to the intermediate transfer belt 11, and in this regard, the intermediate transfer belt 11 is an example of a transfer target which is a material to which an image is to be transferred. Moreover, combinations of the intermediate transfer belt 11 and the primary transfer rollers 14*a* to 14*d* are examples of transfer units. As a result of the primary transfer, a full-color composite toner image is formed on the intermediate transfer belt 11. The composite toner image is fed to the secondary transfer area 16 while being supported on the intermediate transfer belt 11.

Here, Van der Waals forces are applied between the photoreceptor drums 21*a* to 21*d* and the toner supported thereon, and therefore, any toner that is not subjected to primary transfer remains on the circumferential surfaces of the photoreceptor drums 21*a* to 21*d* as untransferred toner. The untransferred toner is fed to the cleaning units 26*a* to 26*d* through rotation of the photoreceptor drums 21*a* to 21*d*.

The cleaning units 26*a* to 26*d* are provided downstream from the primary transfer areas 141*a* to 141*d* in the rotational directions B, and scrape and recover the untransferred toner on the photoreceptor drums 21*a* to 21*d* (i.e., cleaning). The recovered toner in the cleaning units 26*a* to 26*d* is fed by recovery screws to be collected in an unillustrated waste toner box.

Furthermore, the electrostatic latent images that remain on the circumferential surfaces of the photoreceptor drums 21*a* to 21*d* are erased through whole image exposure by the diselectrifying units 27*a* to 27*d*. Here, the diselectrifying units

27*a* to 27*d* are arrays of luminous elements, such as LEDs, provided between the cleaning units 26*a* to 26*d* and the charging units 22*a* to 22*d* in the rotational directions B, each array extending in the depth direction of the image forming apparatus. The circumferential surfaces of the photoreceptor drums 21*a* to 21*d* are illuminated by the arrays of luminous elements, thereby lowering potentials that are persisting on the circumferential surfaces, so that the current image history (memory image) does not remain for the next image formation.

Furthermore, a sheet material fed from the sheet cassette travels in the feeding path R and contacts the timing roller pair (not shown) at rest without rotation. Thereafter, the timing roller pair starts rotating in synchronization with transfer timing in the secondary transfer area 16, thereby feeding the sheet material at temporary rest to the secondary transfer area 16.

In the secondary transfer area 16, the composite toner image on the intermediate transfer belt 11 is transferred to the sheet material introduced from the timing roller pair by the roller 12 and the secondary transfer roller 15 (i.e., secondary transfer). The sheet material subjected to secondary transfer is fed further downstream of the feeding path R by the secondary transfer roller 15 and the intermediate transfer belt 11.

The fusing unit 4 includes a fusing roller and a pressure roller. The sheet material fed from the secondary transfer area 16 is introduced to a nip created by these rollers. The fusing roller heats the toner image on the sheet material passing through the nip, and simultaneously, the pressure roller presses the sheet material. As a result, a full-color toner image is fixed on the sheet material. Thereafter, the fusing roller and the pressure roller forward the sheet material subjected to the fusing process, further downstream of the feeding path R. The forwarded sheet material is ejected onto an output tray after passing through an unillustrated ejection roller.

Configuration of Cleaning Unit

Figure 2:
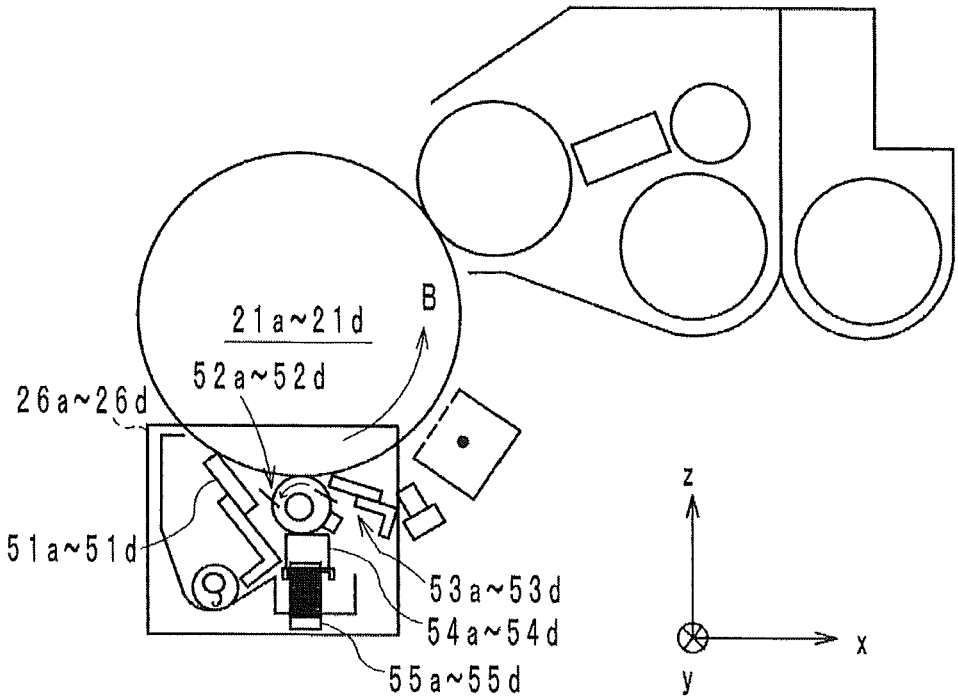
FIG. 2 is a schematic diagram illustrating the configuration of a cleaning unit in FIG. 1.

Next, the configuration of the cleaning units 26*a* to 26*d* will be described in detail. The cleaning units 26*a* to 26*d* include cleaning blades 51*a* to 51*d*, application units 52*a* to 52*d*, leveling units 53*a* to 53*d*, solid lubricants 54*a* to 54*d*, and biasing units 55*a* to 55*d*, as shown in FIG. 2. The cleaning units 26*a* to 26*d* are configured in the same manner, and therefore, the cleaning unit 26*a* will be described below to represent all of the cleaning units.

In the cleaning unit 26*a*, the cleaning blade 51*a*, the application unit 52*a*, and the leveling unit 53*a* are arranged in this order, from upstream to downstream in the rotational direction B.

The cleaning blade 51*a* is made of strips of polyurethane rubber processed by a centrifugal molding machine. The cleaning blade 51*a* is bonded to a retaining plate by a hot-melt adhesive so as to extend in the depth direction of the image forming apparatus. The cleaning blade 51*a* is pressed against the photoreceptor drum 21*a*, thereby scraping untransferred toner adhering to the rotating photoreceptor drum 21*a*.

Figure 3:
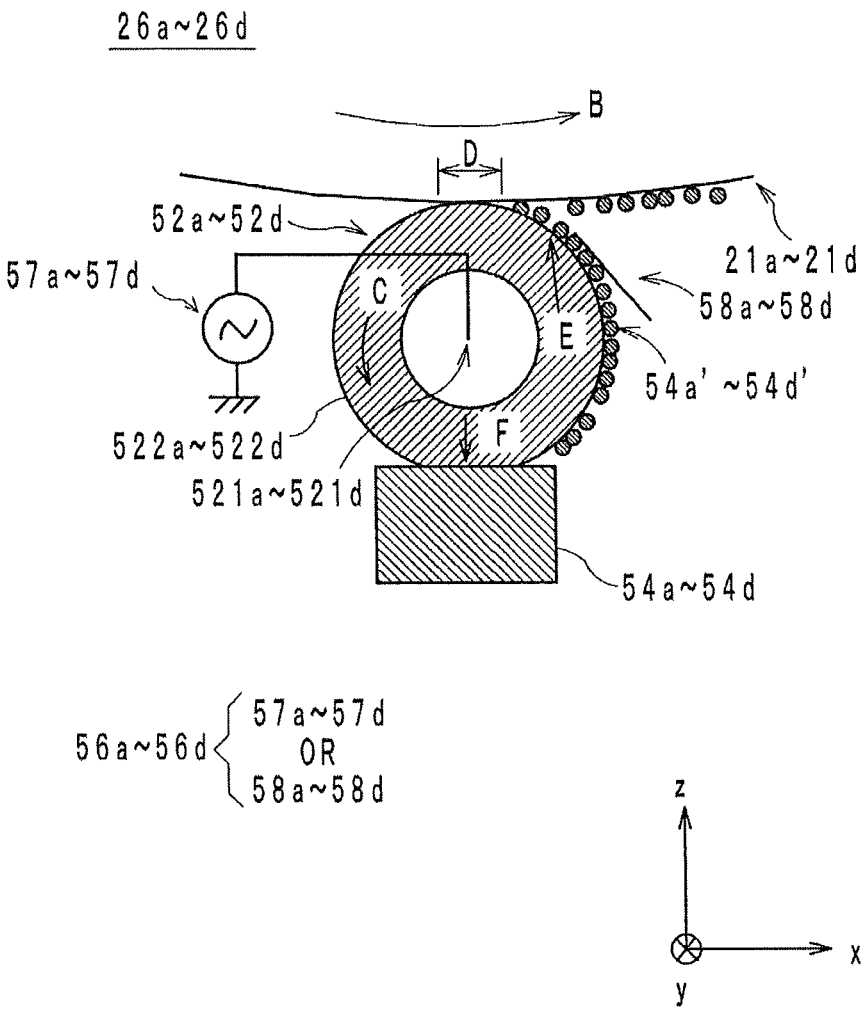
FIG. 3 is a schematic diagram illustrating a configuration example of a moving force providing unit.

The application unit 52*a* extends in the depth direction of the image forming apparatus, and at least includes a metal shaft 521*a* and an application brush 522*a*, as explicitly shown in FIG. 3. The application brush 522*a* is provided in the form of a roll woven into a ground cloth held on the shaft 521*a*, and rotates about the shaft 521*a*. The application unit 52*a* is disposed such that the application brush 522*a* contacts the circumferential surface of the photoreceptor drum 21*a*.

Here, example specifications of the application unit 52*a* will be described in detail. The material of the application brush 522*a* is conductive polyester, and the fiber resistance thereof is about $10^6\Omega$. The application brush 522*a* has a fiber thickness of 3 T (decitex) and a fiber density of 225 kF/inch$^2$. Moreover, the shaft 521*a* is made of iron and has a diameter of 6 mm. Furthermore, the application brush 522*a* has an outer diameter of 12 mm, but the fiber length thereof is about 2.5 mm because it is woven on the ground cloth whose thickness is about 0.5 mm.

FIG. 2 will be referenced again. The solid lubricant 54*a* is provided below the application unit 52*a*. The solid lubricant 54*a* is biased upward by the biasing unit 55*a*, which is, for example, a spring, and pressed against the application brush 522*a* of the application unit 52*a*. More specifically, the solid lubricant 54*a* is shaped by melting zinc stearate powder, and bonded to the plate via a double-side tape because it is brittle and readily broken without reinforcement.

Furthermore, as with the cleaning blade 51*a*, the leveling unit 53*a* is polyurethane rubber produced in the form of a plate by a centrifugal molding machine, and fixed to a retaining plate via a hot-melt adhesive, and the leveling unit 53*a* is angled against rotation of the photoreceptor drum 21*a*.

Operation of Cleaning Unit

Next, the operation of the cleaning unit 26*a* thus configured will be described in detail. In FIG. 3, the application unit 52*a* rotates about the shaft 521*a* in a rotational direction C, which is the same as the rotational direction B, at a higher linear velocity than the photoreceptor drum 21*a* (e.g., at a linear velocity ratio of 1.3 times). The solid lubricant 54*a* is scratched off by rotation of the application unit 52*a* and biasing force of the biasing unit 55*a*, and therefore returns to powder form. This powder will be referred to below as lubricant particles 54*a'*.

The lubricant particles 54*a*' adhere to the application brush 522*a*, and are fed to immediately before the contact area of the photoreceptor drum 21*a* through rotation of the application unit 52*a*, and thereafter the lubricant particles 54*a*' are supplied to the circumferential surface of the photoreceptor drum 21*a* by action of a moving force providing unit 56*a* to be described later.

The lubricant particles 54*a*' on the photoreceptor drum 21*a* are fed to the leveling unit 53*a* shown in FIG. 2 through rotation of the drum 21*a*. The leveling unit 53*a* takes advantage of the thrust on the circumferential surface of the photoreceptor drum 21*a* to form a film of the solid lubricant 54*a* on the circumferential surface. As mentioned above, the solid lubricant 54*a* is zinc stearate. Zinc stearate films are characterized by having high mold releasability and low friction coefficients. Accordingly, such film formation enhances transferability and cleanability of the photoreceptor drum 21*a*. Moreover, use of zinc stearate inhibits friction of the photoreceptor drum 21*a*, and contributes to extension of its service life.

Regarding Moving Force Providing Unit

As has already been described, conventional cleaning units have a problem where the lubricant film with charged products adsorbed thereon remains on the image support, causing image defects. To solve such a problem, the cleaning units 26*a* to 26*d* include, in addition to the features described above, moving force providing units 56*a* to 56*d*, as shown in FIG. 3. For the same reason as mentioned above, the moving force providing unit 56*a* will be described below to represent all of the moving force providing units.

In FIG. 3, the rotational direction of the application unit 52*a* is indicated by arrow C. The contact between the photoreceptor drum 21*a* and the application unit 52*a* is denoted by D.

On the upstream side of the rotational direction C relative to the contact D, the moving force providing unit 56*a* provides the lubricant particles 54*a*' (represented by small circles in the figure) on the application brush 522*a* with a moving force toward the circumferential surface of the photoreceptor drum 21*a*. The lubricant particles 54*a*' move onto the circumferential surface of the photoreceptor drum 21*a* once it approaches so close to the contact D that the moving force provided to the lubricant particles 54*a*' exceeds the adhesion to the application brush 522*a*. Here, the position from which the lubricant particles 54*a*' move onto the photoreceptor drum 21*a* is position E on the circumferential surface of the application brush 522*a*, which is located on the upstream side of the rotational direction C relative to the contact D and is determined mainly by the moving force provided to the lubricant particles 54*a*'.

First Configuration Example of Moving Force Providing Unit

The moving force providing unit 56*a* is capable of electrically providing the moving force. In a typical example of such a case, a power unit 57*a* applies a bias voltage to the shaft 521*a*. Here, the polarity of the difference in the potential on the circumferential surface of the photoreceptor drum 21*a* relative to the application unit 52*a* is taken as a. In addition, when comparing positions in a triboelectric series for the lubricant particles 54*a*' and the application brush 522*a* upon which the lubricant particles 54*a*' are pressed, if the polarity β of the application brush 522*a* coincides with the polarity α, the moving force can be provided to the lubricant particles 54*a*'. Specific examples will be given below.

For example, the surface potential at the contact D of the photoreceptor drum 21*a* is about −100V, and the bias potential applied to the application unit 52*a* is about −300V. In this case, the difference in the potential of the photoreceptor drum 21*a* relative to the application unit 52*a* is +200V, and therefore the polarity α is positive. Moreover, the material of the solid lubricant 54*a* is zinc stearate, and the material of the application brush 522*a* to be brought into contact therewith is polyester. In this case, the position of polyester in the triboelectric series is on the positive side relative to zinc stearate, the polarity β is positive, and coincides with the polarity α. In this case, the lubricant particles 54*a*' are negatively charged, and therefore the lubricant particles 54*a*' receive an electric force applied by the application unit 52*a* toward the photoreceptor drum 21*a*, and move onto the circumferential surface of the photoreceptor drum 21*a* with high efficiency.

Figure 4A:
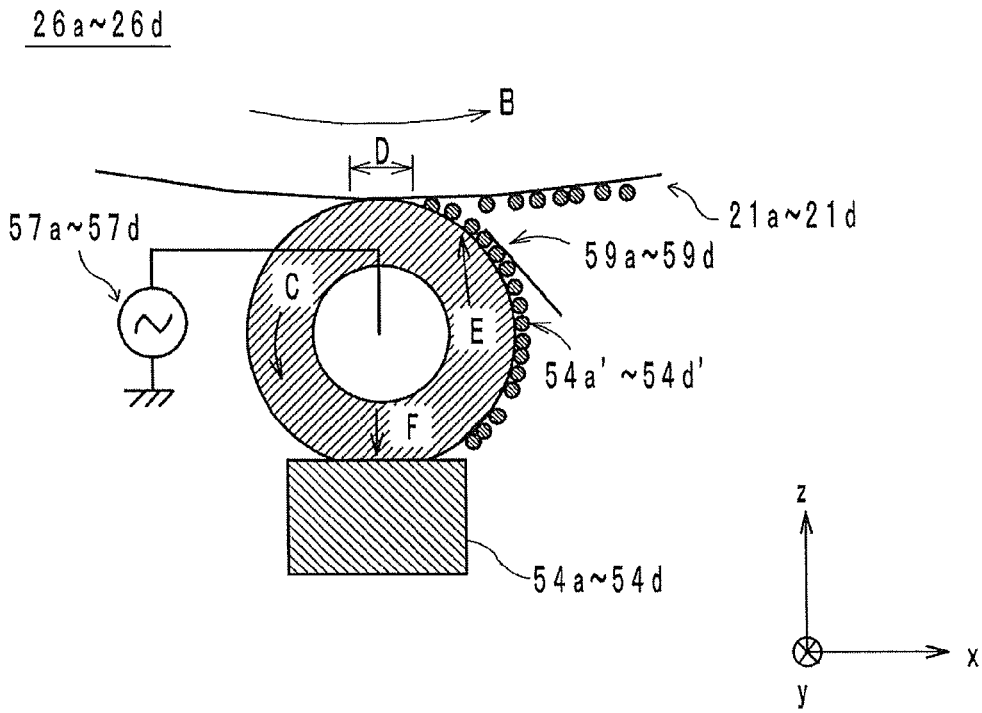
FIG. 4A is a schematic diagram illustrating a first configuration example for first and second auxiliary charge members.
Figure 4B:
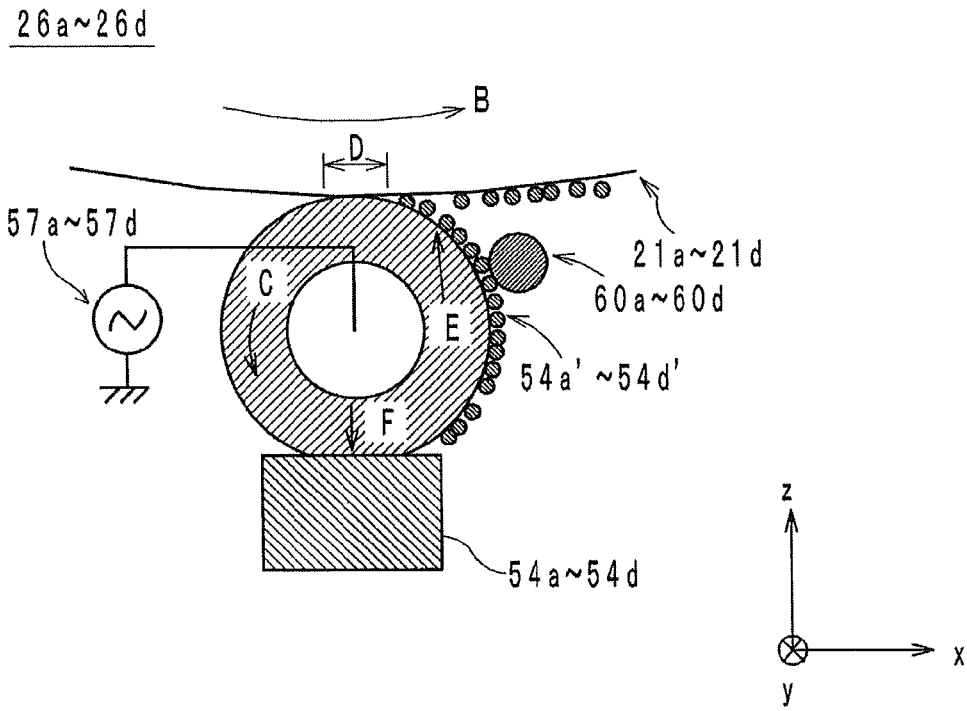
FIG. 4B is a schematic diagram illustrating a second configuration example for the first and second auxiliary charge members.

The above embodiment has been described with respect to the example where an electric force from the power unit 57*a* acts on the lubricant particles 54*a*'. However, in addition to this, a first auxiliary charge member 59*a* and a second auxiliary charge member 60*a* may be provided between the position F of the solid lubricant 54*a* and the contact D in the rotational direction C, as shown in FIGS. 4A and 4B, such that they are pressed upon lubricant particles 54*a*' that are being fed, at the upstream from position E. The auxiliary charge member 59*a* is in the form of strips of plate extending in the depth direction (i.e., the direction parallel to the shaft 521*a*), as in the case of a first deforming unit 58*a* to be described later, and the auxiliary charge member 60*a* is in the form of a rod extending in the depth direction. The auxiliary charge members 59*a* and 60*a* contact the lubricant particles 54*a*', thereby frictionally charging them. Thus, the moving force providing unit 56*a* can allow the lubricant particles 54*a*' to move onto the photoreceptor drum 21*a* with higher efficiency.

Here, if the auxiliary charge member 60*a* has a corrugated surface profile in a plan view from the depth direction (i.e., the direction parallel to the shaft 521*a*), contact area with the application brush 522*a* can be increased. As a result, the lubricant particles 54*a*' can be increased in frictional charge quantity, and the moving force applied thereto can be further increased. The surface profile may be in the form of sinusoidal, triangular, or rectangular waves, or may be a combination thereof.

Furthermore, the power unit 57*a* may apply a direct-current voltage superimposed with an alternating-current voltage to the application unit 52*a* as a bias voltage, thereby applying an oscillating electric field to the lubricant particles 54*a*'. As a result, the lubricant particles 54*a*' can further readily move onto the photoreceptor drum 21*a*. Moreover, the superimposition of the alternating-current voltage produces the effect of causing the application brush 522*a* to be in microoscillations, so that the mobility of the lubricant particles 54*a*' can be further enhanced. In addition, the application brush 522*a* in microoscillations rubs the photoreceptor drum 21*a*, producing the effect of enhancing the scrubbing force of the photoreceptor drum 21*a*.

Furthermore, a bias voltage of the same polarity as the charge polarity of the lubricant particles 54*a*' can be applied to the auxiliary charge members 59*a* and 60*a*, as shown in FIGS. 4A and 4B, so that the lubricant particles 54*a*' can be increased in charge quantity, and the moving force applied to the lubricant particles 54*a*' can be further increased.

Second Configuration Example of Moving Force Providing Unit

The moving force providing unit 56*a* can mechanically provide the moving force without using the power unit 57*a*. In a typical example of such a case, the first deforming unit 58*a* is provided at position E, as shown in FIG. 3. The first deforming unit 58*a* is in the form of strips of rigid material extending in the depth direction of the image forming apparatus, and the first deforming unit 58*a* contacts and flexibly deforms the rotating application brush 522*a*. The deformed application brush 522*a* returns to its original shape after it passes the first deforming unit 58*a* by rotating in the direction indicated by arrow C. As a result, lubricant particles 54*a*' adhering to the application brush 522*a* are caused to leap out onto the circumferential surface of the photoreceptor drum 21*a*. To achieve such action, the first deforming unit 58*a* is configured such that the amount of its bite in the application brush 522*a* at the position where it becomes out of touch with the application brush 522*a* is greater than the amount of bite by the first auxiliary charge member 59*a*. Here, the first auxiliary charge member 59*a* is not designed to cause the lubricant particles 54*a*' to leap out, and therefore the amount of its bite in the application brush 522*a* is relatively low.

Supplementary 1

By using both the power unit 57*a* and the first deforming unit 58*a*, it is rendered possible for the lubricant particles 54*a* to further readily move from the application brush 522*a* onto the circumferential surface of the photoreceptor drum 21*a*. Note that in the case where both of the units are used, it is necessary that a bias voltage opposite in polarity to the lubricant particles 54*a*' is applied to the first deforming unit 58*a*.

Supplementary 2

Furthermore, as in the present embodiment, the application unit 52*a* rotates at a higher linear velocity than the photoreceptor drum 21*a*. This is more desirable because foreign matter scraped from the photoreceptor drum 21*a* by the application brush 522*a* can be prevented from readhering to the drum 21*a*.

Figure 5:
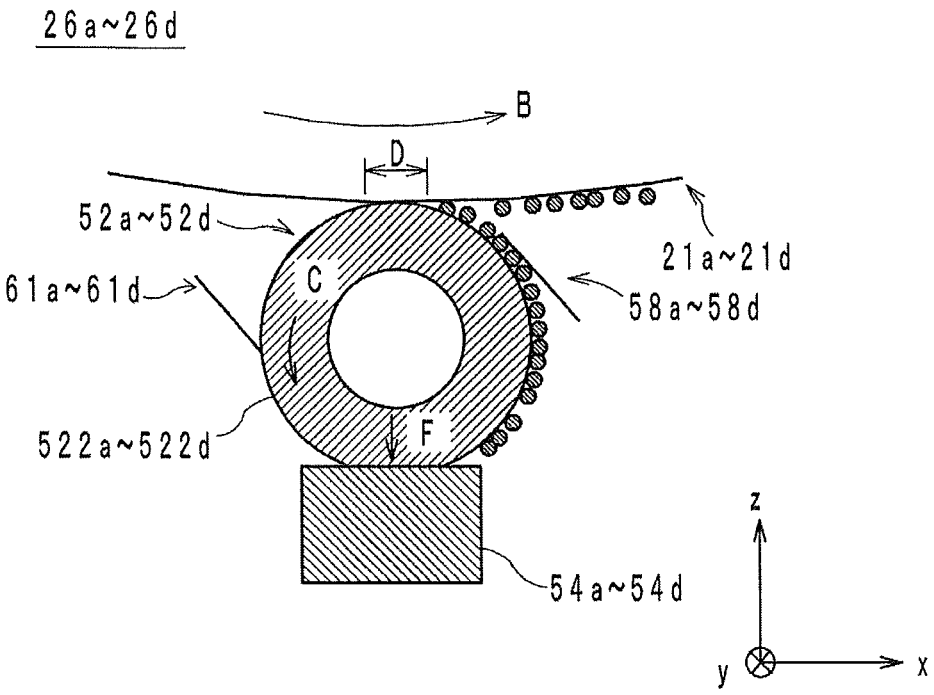
FIG. 5 is a schematic diagram illustrating the configuration of a second flexible member.

Furthermore, a second deforming unit 61*a* having the same configuration as the first deforming unit 58*a* is preferably provided between the contact D and the position F of the solid lubricant 54*a* in the rotational direction C, as shown in FIG. 5. By the second deforming unit 61*a* forcibly taking the scraped foreign matter away from the application brush 522*a*, the foreign matter can be prevented from readhering to the photoreceptor drum 21*a*. Note that the power unit 57*a* is omitted in FIG. 5.

Supplementary 3

Furthermore, the example where both of the polarities α and β are positive is presented in the above embodiment. However, this is not restrictive, and a similar effect can be achieved even in the case where both of the polarities α and β are negative so long as the potentials of the photoreceptor drum 21*a* and the application unit 52*a*, and the materials of the solid lubricant 54*a* and the application brush 522 are appropriately selected.

Supplementary 4

Furthermore, in the above embodiment, the image forming apparatus uses the intermediate transfer belt 11 to form a full-color toner image. However, this is not restrictive, and the image forming apparatus may be capable of simply forming a monochrome image without using the intermediate transfer belt. In such a case, the transfer roller and the photoreceptor drum, which also acts as an image support, function as transfer members, and a toner image on the photoreceptor drum is directly transferred onto a sheet material (e.g., paper; another example of the transfer target) introduced between the roller and the drum.

Effects of Moving Force Providing Unit

As described above, the moving force providing unit 56*a* causes the lubricant particles 54*a*' to move from position E at the upstream relative to the contact D, onto the circumferential surface of the photoreceptor drum 21*a*, so that the amount of lubricant particles 54*a*' to be fed to the contact D can be suppressed much more significantly than can conventionally be suppressed. As a result, the application unit 52*a* can apply a constant scrubbing force to the photoreceptor drum 21*a*, thereby scraping charged products adsorbed on the circumferential surface thereof. Thus, occurrence of image defects can be prevented.

Here, to confirm the effect of the moving force providing unit 56*a*, the present inventors evaluated image defect occurrence levels for a conventional image forming apparatus and the image forming apparatus according to the present embodiment.

The equipment used for evaluation was bizhub C8000 (A4Y: 80 pages/min.) manufactured by Konica Minolta Business Technologies, Inc. The present inventors used this equipment to intermittently print six pages of character image at 5% image coverage in a hygrothermal environment at 23° C. and 65% RH, and also print 1,000 pages of character image at 5% image coverage in a hot and humid (HH) environment (30° C. and 85% RH) every 200,000 revolutions of the photoreceptor drum. Immediately after completion of the printing, the equipment was turned off, and after an eight-hour halt, half-tone images were outputted and then evaluated. The above evaluation was carried out until the cumulative number of photoreceptor drum revolutions reached 1,200,000.

Table 1 below shows the results of evaluation performed on the image forming apparatus according to the present embodiment.

TABLE 1

| | Members that contact application brush | | | | |
|---|---|---|---|---|---|
| | Upstream ← | Rotational direction C of application unit | | | Downstream → |
| Example 1 | Solid lubricant | Second auxiliary charge member | First deforming unit | Photoreceptor drum | Second deforming unit |
| Example 2 | Solid lubricant | First auxiliary charge member | First deforming unit | Photoreceptor drum | Second deforming unit |
| Example 3 | Solid lubricant | First deforming unit | Photoreceptor drum | Second deforming unit | — |
| Example 4 | Solid lubricant | First auxiliary charge member | Photoreceptor drum | Second deforming unit | — |
| Example 5 | Solid lubricant | First auxiliary charge member | Photoreceptor drum | Second deforming unit | — |
| Example 6 | Solid lubricant | Photoreceptor drum | Second deforming unit | — | — |
| Example 7 | Solid lubricant | Photoreceptor drum | — | — | — |

| | Rotational direction of application | Bias voltage of application unit | Coincidence between polarities alpha and beta | Image defect evaluation results by number of revolutions of photoreceptor drum | | | | | |
|---|---|---|---|---|---|---|---|---|---|
| | | | | 200k rev. | 400k rev. | 600k rev. | 800k rev. | 1000k rev. | 1200k rev. |
| Example 1 | Counter | Vdc: −300 V +AC superimposed | A | A | A | A | A | A | A |
| Example 2 | Counter | Vdc: −300 V +AC superimposed | A | A | A | A | A | A | B |

TABLE 1-continued

| | | | | | | | | | |
|---|---|---|---|---|---|---|---|---|---|
| Example 3 | Counter | Vdc: −300 V +AC superimposed | A | A | A | A | A | B | B |
| Example 4 | Counter | Vdc: −300 V +AC superimposed | A | A | A | A | B | B | B |
| Example 5 | Counter | Vdc: −300 V | A | A | A | A | B | B | C |
| Example 6 | Counter | Vdc: −300 V +AC superimposed | A | A | A | A | B | B | B |
| Example 7 | Counter | Vdc: −300 V +AC superimposed | A | A | A | A | B | B | C |

Note:
In the "Coincidence between polarities alpha and beta" filed, "A" denotes that the polarities coincide with each other.

In the image defect evaluation results of Table 1, each "A" denotes no occurrence of image defect, each "B" denotes occurrence of minor image defect, and each "C" denotes occurrence of major image defect. In addition, the solid lubricant used was zinc stearate, the materials used for the auxiliary charge member and the flexible members were nylon sheets, and the material used for the application brush 522*a* of the application unit was polyester. Moreover, a −300V direct-current bias voltage superimposed with an alternating-current bias voltage having amplitude of −800V and a frequency of 1 kHz was applied to the application unit. However, as for Example 5, the direct-current bias voltage was applied alone without being superimposed with the alternating-current bias voltage. Moreover, the surface potential of the photoreceptor drum was −100V in a section downstream from the primary transfer roller 14 but upstream from the diselectrifying unit 27.

As can be appreciated from Table 1, in the image forming apparatus according to the present embodiment, no major image defect occurred up to 1,000,000 pages of printing, although some minor image defects occurred. Particularly as in Example 1 shown in the top panel of Table 1, where the application brush 522*a* shown in FIG. 3 was contacted by, in order from upstream in the rotational direction, the solid lubricant 54*a*, the auxiliary charge member 60*a* (see FIG. 4B), the first deforming unit 58*a*, the photoreceptor drum 21*a*, and the second deforming unit 61*a* (see FIG. 5), no occurrence of image defect was confirmed in evaluation conducted after 1,200,000 pages of printing. A reason for this is because the lubricant particles were increased in charge quantity, thereby increasing the electric moving force, and the mechanical moving force was added to promote supply of the lubricant particles at position E upstream from the contact D, thereby creating a state where no lubricant particles were present at the contact D. Another reason is because the application brush 522*a* scraped charged products adhering to the surface of the photoreceptor drum 21*a*, and the second deforming unit 61*a* forcibly took the scraped charged products and any lubricant film with adhering charged products, away from the application brush 522*a*, thereby making the lubricant film on the photoreceptor drum 21*a* free of adhering charged products. Thus, the present invention was confirmed to be effective in inhibiting image defects.

Furthermore, the conventional image forming apparatus was evaluated in the same manner as above, and the results of the evaluation are shown in Table 2. Here, in Table 2, the material of the application brush used in Comparative Examples 1 to 5, 7, and 8 was polytetrafluoroethylene pile, and the material used in Comparative Example 6 was polyester. Moreover, the specifications of the application brush in the conventional image forming apparatus were the same as those of the application brush 522*a*, except for the material. In addition, the position of polytetrafluoroethylene pile in the triboelectric series is on the negative side relative to zinc stearate, and therefore the polarity β was negative and did not coincide with the polarity α.

TABLE 2

| | Members that contact application brush | | | | |
|---|---|---|---|---|---|
| | ← Upstream | Rotational direction C of application unit | | | Downstream → |
| Comparative example 1 | Solid lubricant | Photoreceptor drum | — | — | — |
| Comparative example 2 | Solid lubricant | Photoreceptor drum | — | — | — |
| Comparative example 3 | Solid lubricant | Photoreceptor drum | — | — | — |
| Comparative example 4 | Solid lubricant | Photoreceptor drum | First deforming unit | — | — |
| Comparative example 5 | Solid lubricant | Photoreceptor drum | First deforming unit | — | — |
| Comparative example 6 | Solid lubricant | First auxiliary charge member | First deforming unit | Photoreceptor drum | Second deforming unit |
| Comparative example 7 | Solid lubricant | First auxiliary charge member | First deforming unit | Photoreceptor drum | Second deforming unit |
| Comparative example 8 | Solid lubricant | First auxiliary charge member | First deforming unit | Photoreceptor drum | Second deforming unit |

TABLE 2-continued

| | Rotational direction of application | Bias voltage of application unit | Coincidence between polarities alpha and beta | Image defect evaluation results by number of revolutions of photoreceptor drum | | | | | |
|---|---|---|---|---|---|---|---|---|---|
| | | | | 200k rev. | 400k rev. | 600k rev. | 800k rev. | 1000k rev. | 1200k rev. |
| Comparative example 1 | Counter | GND | B | A | C | C | C | C | C |
| Comparative example 2 | Forward | GND | B | B | C | C | C | C | C |
| Comparative example 3 | Counter | Vdc: −300 V | B | A | C | C | C | C | C |
| Comparative example 4 | Counter | GND | B | A | B | C | C | C | C |
| Comparative example 5 | Counter | Vdc: −300 V | B | A | B | C | C | C | C |
| Comparative example 6 | Forward | Vdc: −300 V +AC superimposed | A | A | C | C | C | C | C |
| Comparative example 7 | Forward | Vdc: −300 V +AC superimposed | B | A | C | C | C | C | C |
| Comparative example 8 | Counter | Vdc: −300 V +AC superimposed | B | A | A | B | C | C | C |

Note:
In the "Coincidence between polarities alpha and beta" filed, "A" denotes that the polarities coincide with each other and "B" denotes that the polarities do not coincide with each other.

As shown in Table 2, for Comparative Examples 1 to 5 without the moving force providing unit 56*a*, image defects occurred in a short period of time.

Figure 6:
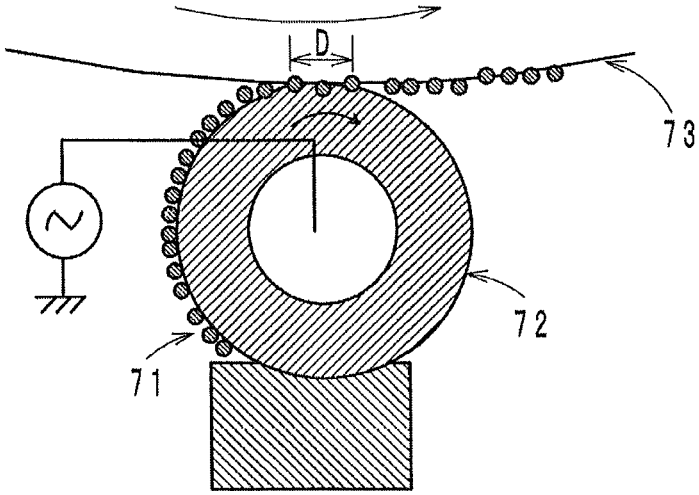
FIG. 6 is a schematic diagram illustrating the configuration of Comparative Example 6.
Figure 7:
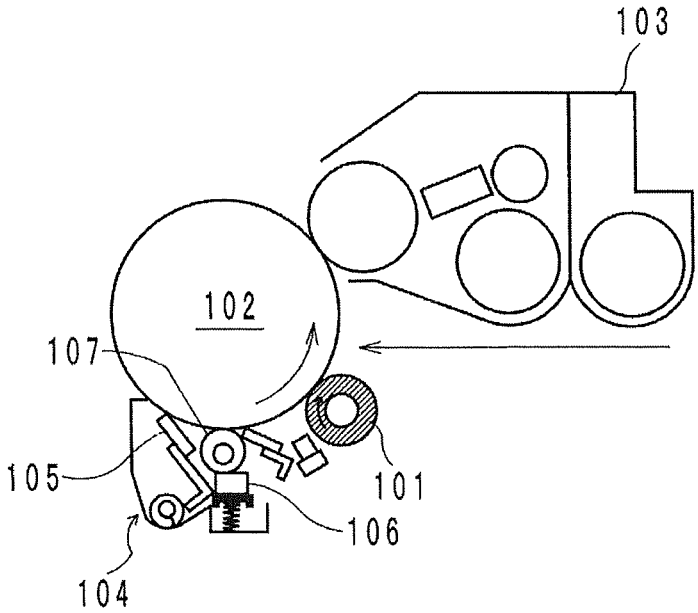
FIG. 7 is a schematic diagram illustrating the configuration of a conventional cleaning unit.
Figure 8:
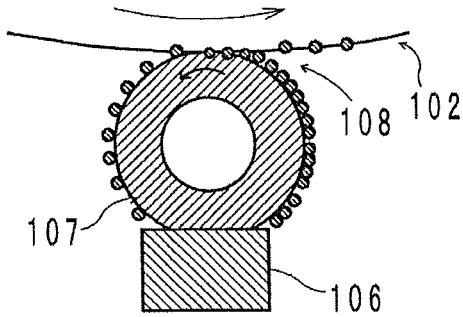
FIG. 8 is a schematic diagram illustrating the behavior of lubricant particles on a conventional application brush.

Furthermore, as shown in FIG. 6, even in the case where an electric moving force was provided to lubricant particles 71, when an application brush 72 rotated in the same direction as a photoreceptor drum 73, i.e., in a forward direction, the lubricant particles 71 were supplied to the photoreceptor drum 73 at the upstream from the contact D, as in Comparative Example 6. However, this resulted in numerous lubricant particles 71 being present at the contact D, so that the capability of the application brush 72 scraping the photoreceptor drum 73 was not exercised, leading to image defect occurrence in a short time frame.

Furthermore, in Comparative Examples 1 to 5, 7, and 8, the material of the application brush was polytetrafluoroethylene pile. The position of polytetrafluoroethylene pile in the triboelectric series is on the negative side relative to zinc stearate, and therefore the polarity β was negative, and did not coincide with the polarity α. In this case, lubricant particles did not receive electric force applied by the application brush toward the photoreceptor drum, and therefore did not move onto the photoreceptor drum, leading to image defect occurrence in a short time frame.

Regarding Other Effects

Furthermore, in a preferred example of the present embodiment, the power unit 57*a* applies a direct-current voltage superimposed with an alternating-current voltage to the application unit 52*a* as a bias voltage, thereby applying an oscillating electric field to the lubricant particles 54*a*'. As a result, the lubricant particles 54*a*' can further readily move onto the photoreceptor drum 21*a*.

Furthermore, in the present embodiment, the first and second auxiliary charge members 59*a* and 60*a* frictionally charge the lubricant particles 54*a*'. Thus, the lubricant particles 54*a*' can move onto the photoreceptor drum 21*a* with higher efficiency.

Furthermore, if the second auxiliary charge member 60*a* has a corrugated surface profile in a plan view from the direction parallel to the shaft 521*a*, contact area with the application brush 522*a* can be increased. Thus, the lubricant particles 54*a*' can be increased in frictional charge quantity.

Furthermore, a bias voltage of the same polarity as the lubricant particles 54*a*' is applied to the first and second auxiliary charge members 59*a* and 60*a*. This produces the effect of further increasing the moving force applied to the lubricant particles 54*a'*.

Furthermore, in the present embodiment, the second deforming unit 61*a* flexibly deforms the rotating application brush 522*a* after the rotating application brush 522*a* scrapes foreign matter from the circumferential surface of the photoreceptor drum 21*a*. The application brush 522*a* returns to its original shape after it passes the second deforming unit 61*a*, and therefore the scraped foreign matter is forcibly taken away from the application brush 522*a*. Thus, the foreign matter can be prevented from readhering to the photoreceptor drum 21*a*.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

a rotatable image support;

a charging unit that charges the image support;

an exposing unit that exposes the image support charged by the charging unit, thereby forming an electrostatic latent image;

a developing unit that develops the electrostatic latent image formed by the exposing unit, thereby forming a toner image on the image support;

a transfer unit that transfers the toner image formed on the image support to a transfer target in a transfer area; and a cleaning unit, wherein, the cleaning unit is provided downstream from the transfer area in a rotational direction of the image support, and a cleaning unit, wherein, the cleaning unit includes:

a cleaning blade that is provided downstream from the transfer area in a rotational direction of the image support and scrapes off untransferred toner remaining on the image support;

an application brush that contacts the image support on the downstream side in the rotational direction of the image support relative to the cleaning blade, the application brush rotating in a counter direction at a contact position with the image support, thereby scratching off lubricant particles from a solid lubricant provided at its periphery, and supporting and feeding the lubricant particles toward the contact position with the image support; and a moving force providing unit that provides the lubricant being fed by the application brush with an electrical moving force toward the image support, on the upstream side in the rotational direction of the application brush relative to the contact position of the image support and the application brush.

2. The image forming apparatus according to claim 1, wherein the moving force providing unit is a power unit that provides an electric force to the lubricant as the moving force toward the image support.

3. The image forming apparatus according to claim 2, wherein, the power unit applies a bias voltage to the application brush, and when comparing positions in a triboelectric series for the lubricant and the application brush, a polarity $\beta$ of the application brush coincides with a polarity $\alpha$ of a potential difference on a surface of the image support relative to the application brush.

4. The image forming apparatus according to claim 3, wherein the bias voltage applied to the application brush by the power unit is a direct-current voltage superimposed with an alternating-current voltage.

5. The image forming apparatus according to claim 1, wherein the application brush further includes an auxiliary charge member that frictionally charges the lubricant by contacting the lubricant on the upstream side in the rotational direction of the application brush relative to a position from which the lubricant moves onto the image support.

6. The image forming apparatus according to claim 5, wherein the auxiliary charge member is in the form of strips extending in parallel with a rotational axis of the application brush.

7. The image forming apparatus according to claim 5, wherein the auxiliary charge member is in the form of a rod having a corrugated profile in a plan view from the direction of the rotational axis of the application brush.

8. The image forming apparatus according to claim 5, wherein the auxiliary charge member has applied thereto a bias voltage of the same polarity as a charge polarity of the lubricant supported on the application brush.

9. The image forming apparatus according to claim 1, further comprising a first deforming unit that flexibly deforms the application brush with the lubricant supported thereon, on the upstream side in the rotational direction of the application brush relative to a contact position of the image support and the application brush.

10. The image forming apparatus according to claim 9, further comprising a second deforming unit that flexibly deforms the application brush on the downstream side in the rotational direction of the application brush relative to the contact position of the image support and the application brush after the application brush scrapes off foreign matter from a circumferential surface of a photoreceptor drum.

* * * * *